US009938881B2

(12) United States Patent
Yamada

(10) Patent No.: US 9,938,881 B2
(45) Date of Patent: Apr. 10, 2018

(54) COOLING WATER PASSAGE STRUCTURE OF INTERNAL COMBUSTION ENGINE

(71) Applicant: SUZUKI MOTOR CORPORATION, Hamamatsu-shi, Shizuoka (JP)

(72) Inventor: Ikuo Yamada, Hamamatsu (JP)

(73) Assignee: SUZUKI MOTOR CORPORATION, Hamamatsu-Shi, Shizuoka (JP)

( * ) Notice: Subject to any disclaimer, the term of this patent is extended or adjusted under 35 U.S.C. 154(b) by 1 day.

(21) Appl. No.: 15/058,871

(22) Filed: Mar. 2, 2016

(65) Prior Publication Data

US 2016/0273482 A1 Sep. 22, 2016

(30) Foreign Application Priority Data

Mar. 20, 2015 (JP) ..... 2015-058469

(51) Int. Cl.

| | |
|---|---|
| ***F02F 1/40*** | (2006.01) |
| ***F01P 3/02*** | (2006.01) |
| ***F02F 1/38*** | (2006.01) |
| *F01P 7/16* | (2006.01) |
| *F02F 1/10* | (2006.01) |

(Continued)

(52) U.S. Cl.

CPC ..... *F01P 3/02* (2013.01); *F02F 1/38* (2013.01); *F01P 7/165* (2013.01); *F01P 11/04* (2013.01); *F01P 2003/021* (2013.01); *F01P 2003/027* (2013.01); *F01P 2007/168* (2013.01); *F01P 2050/16* (2013.01); *F02F 1/10* (2013.01);

(Continued)

(58) Field of Classification Search

CPC ..... F02F 1/40; F02F 1/10; F02F 1/24; F01P 7/165; F01P 2007/168

USPC ..... 123/41.82 R

See application file for complete search history.

(56) References Cited

U.S. PATENT DOCUMENTS

| | | | | |
|---|---|---|---|---|
| 2001/0023670 A1* | 9/2001 | Kuga | F01P 3/02 | 123/41.72 |
| 2012/0132156 A1* | 5/2012 | Schlidt | F02F 1/40 | 123/41.79 |
| 2013/0239915 A1* | 9/2013 | Beyer | F02F 1/40 | 123/41.74 |

FOREIGN PATENT DOCUMENTS

| | | |
|---|---|---|
| AT | 2106 U1 | 4/1998 |
| AT | 501229 A1 | 7/2006 |

(Continued)

OTHER PUBLICATIONS

Office Action dated on Oct. 27, 2017 during the prosecution of German Patent Application 10 2016 104 109.2.

*Primary Examiner* — Jacob Amick
*Assistant Examiner* — Charles Brauch
(74) *Attorney, Agent, or Firm* — Troutman Sanders LLP

(57) ABSTRACT

A cooling water passage structure of internal combustion engine includes a cylinder-block-side cooling water passage, a cylinder-head-side cooling water passage, a heat exchanger, and cooling water passage pipes. The cylinder-block-side cooling water passage is formed inside a cylinder block of an engine to cause cooling water to flow through. The cylinder-head-side cooling water passage is formed inside a cylinder head to cause cooling water to flow through. The heat exchanger is configured to dissipate heat of cooling water to external air to decrease a temperature of the cooling water. The cooling water passage pipes couple the heat exchanger and the engine to exchange cooling water. The cylinder head includes a cooling water inlet. The (Continued)

cooling water passage pipe is coupled to the cooling water inlet. The cooling water from the heat exchanger flows into the cooling water inlet.

9 Claims, 8 Drawing Sheets

(51) Int. Cl.
*F02F 1/24* (2006.01)
*F01P 11/04* (2006.01)

(52) U.S. Cl.
CPC ..... *F02F 1/24* (2013.01); *F02F 1/40* (2013.01); *F02F 2001/104* (2013.01)

(56) References Cited

FOREIGN PATENT DOCUMENTS

| | | | | | |
|---|---|---|---|---|---|
| DE | 02013204193 | A1 | | 9/2013 | |
| JP | 358113557 | A | * | 7/1983 | ..... F02F 1/40 |
| JP | S58113557 | A | * | 7/1983 | |
| JP | S58113557 | A | | 7/1983 | |
| JP | H04350348 | A | | 12/1992 | |
| JP | 2001221107 | A | * | 8/2001 | |

* cited by examiner

COOLING WATER PASSAGE STRUCTURE OF INTERNAL COMBUSTION ENGINE

CROSS-REFERENCE TO RELATED APPLICATION

This application is based upon and claims the benefit of priority of the prior Japanese Patent Application No. 2015-058469, filed on Mar. 20, 2015, the entire contents of which are incorporated herein by reference.

BACKGROUND OF THE INVENTION

Field of the Invention

The present invention relates to a cooling water passage structure in an internal combustion engine, which is an engine mounted to a vehicle such as a motorcycle.

Description of the Related Art

Conventionally, in a vehicle such as a motorcycle, as disclosed in Patent Document 1, for example, the cooling water passage is disposed inside the cylinder block and the cylinder head of the engine, which is the internal combustion engine. The inlet for cooling water is disposed on the cylinder block side, and the outlet is disposed on the cylinder head side. With this cooling water passage structure of engine, cooling water cooled by the heat exchanger first flows through the cylinder block to cool the cylinder block, and then flows into the cylinder head to cool the cylinder head. Finally, the cooling water is recirculated to the heat exchanger to be cooled again. Patent Document 1: Japanese Laid-open Patent Publication No. 04-350348

However, to sufficiently cool the cylinder head with the conventional cooling water passage structure, a larger amount of cooling water needs to flow into the cylinder block first. This conversely results in a tendency of over-cooling of the cylinder block side. Leaving the cylinder block as it is may cause a problem such as a deterioration of combustion efficiency.

SUMMARY OF THE INVENTION

To solve the actual conditions, an object of the present invention is to provide a cooling water passage structure of internal combustion engine that efficiently cools a cylinder block and a cylinder head in a balanced manner.

The cooling water passage structure of internal combustion engine of the present invention includes a cylinder-block-side cooling water passage, a cylinder-head-side cooling water passage, a heat exchanger, a cooling water passage pipe. The cylinder-block-side cooling water passage is formed inside a cylinder block of an engine to cause cooling water to flow through. The cylinder-head-side cooling water passage is formed inside a cylinder head to cause cooling water to flow through. The heat exchanger is configured to dissipate heat of cooling water to external air to decrease a temperature of the cooling water. The cooling water passage pipe couples the heat exchanger and the engine to exchange cooling water. The cylinder head includes a cooling water inlet. The cooling water passage pipe is coupled to the cooling water inlet. The cooling water from the heat exchanger flows into the cooling water inlet.

The cooling water passage structure of internal combustion engine of the present invention is configured as follows. The cylinder-head-side cooling water passage branches at an upstream at an intermediate portion. The one branched cylinder-head-side cooling water passage communicates with the cylinder-block-side cooling water passage to cause cooling water to flow to the cylinder block side.

The cooling water passage structure of internal combustion engine of the present invention is configured as follows. The cylinder head includes a cooling water outlet through which cooling water flows out.

The cooling water passage structure of internal combustion engine of the present invention is configured as follows. The cylinder-head-side cooling water passage communicates with the cylinder-block-side cooling water passage at a downstream at an intermediate portion to converge cooling water that has flown through the cylinder block side to cooling water on the cylinder head side.

The cooling water passage structure of internal combustion engine of the present invention is configured as follows. The cooling water inlet of the cylinder head is disposed on a side surface of the cylinder head. The cooling water inlet is disposed biased to an exhaust port side with respect to a cylinder axis line.

The cooling water passage structure of internal combustion engine of the present invention is configured as follows. The cooling water outlet at the cylinder head is disposed above the cooling water inlet at the cylinder head.

The cooling water passage structure of internal combustion engine of the present invention is configured as follows. The cooling water outlet at the cylinder head is disposed on an opposite side from the cooling water inlet among side surfaces of the cylinder head. The cooling water outlet is disposed biased to an intake port side with respect to a cylinder axis line.

The cooling water passage structure of internal combustion engine of the present invention is configured as follows. The cylinder head includes a storage chamber on an end portion at one side of the cylinder head. The storage chamber houses a drive mechanism of a valve gear. The cooling water inlet passes through the storage chamber to communicate the cylinder-block-side cooling water passage and an outside of the cylinder head.

DETAILED DESCRIPTION OF THE PREFERRED EMBODIMENTS

The following describes preferred embodiments of a cooling water passage structure of internal combustion engine according to the present invention with reference to the drawings.

Figure 1:
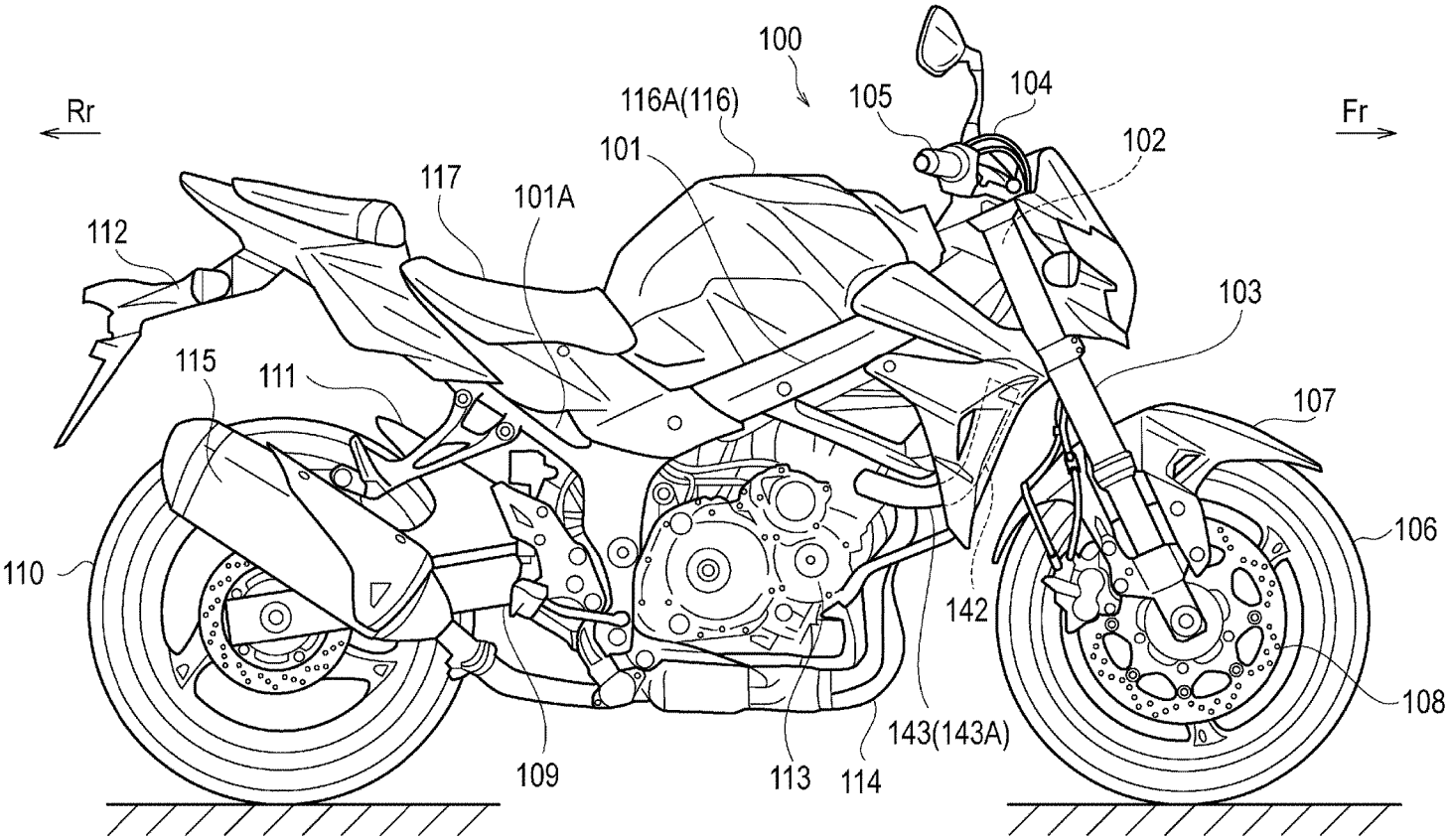
FIG. 1 is a side view of a motorcycle according to an embodiment of the present invention.

FIG. 1 is a side view of a motorcycle 100 as an application example of the present invention. First, using FIG. 1, the following describes the overall configuration of the motorcycle 100. Including FIG. 1, the drawings used in the following description indicate the front side of the vehicle by an arrow Fr and the rear side of the vehicle by an arrow Rr as necessary. Additionally, an arrow R indicates the right lateral side of the vehicle while an arrow L indicates the left lateral side of the vehicle.

In FIG. 1, on the front portion of a vehicle body frame 101 (a main frame), which is made of steel or an aluminum alloy material, two front forks 103 are disposed on the right and left. The front forks 103 are turnably supported by a steering head pipe 102 to the right and left. A handlebar 104 is secured to the upper ends of the front forks 103. The handlebar 104 includes grips 105 on both ends. On the lower portion of the front forks 103, a front wheel 106 is rotatably supported. A front fender 107 is secured so as to cover the upper portion of the front wheel 106. The front wheel 106 includes a brake disc 108, which rotates integrally with the front wheel 106.

The vehicle body frame 101 is integrally joined to the rear portion of the steering head pipe 102 and is branched into two of right and left pair to the rear. The vehicle body frame 101 is disposed to extend widening from the steering head pipe 102 downward to the rear. This example employs a so-called twin-spar frame, which is used preferably for vehicles where high-speed performance is required. A seat rail 101A is appropriately inclined from the vicinity of the rear portion of the vehicle body frame 101 upward to the rear and extends to the rear to support a sitting seat, which will be described later. To the rear portion of the vehicle body frame 101, a swing arm 109 is swingably joined. A rear shock absorber is installed in a predetermined manner between the vehicle body frame 101 and the swing arm 109. To the rear end of the swing arm 109, a rear wheel 110 is rotatably supported. The rear wheel 110 is rotatively driven via a driven sprocket around which a chain, which transmits power of an engine, is wound. At the peripheral area immediately close to the rear wheel 110, an inner fender 111, which covers near the front upper portion of the rear wheel 110, is disposed. Above the inner fender 111, a rear fender 112 may be disposed.

An air-fuel mixture, which consists of air and fuel and is to be supplied, is supplied from respective air cleaner and fuel supply device (not illustrated) to an engine unit 113 mounted to the vehicle body frame 101. Through an exhaust pipe 114, exhaust gas generated after burning inside the engine is exhausted from a muffler 115. A fuel tank 116 is mounted to the upper side of the engine unit 113 and is covered with a tank cover 116A. A sitting seat 117 is successively provided to the rear of the fuel tank 116.

Figure 2:
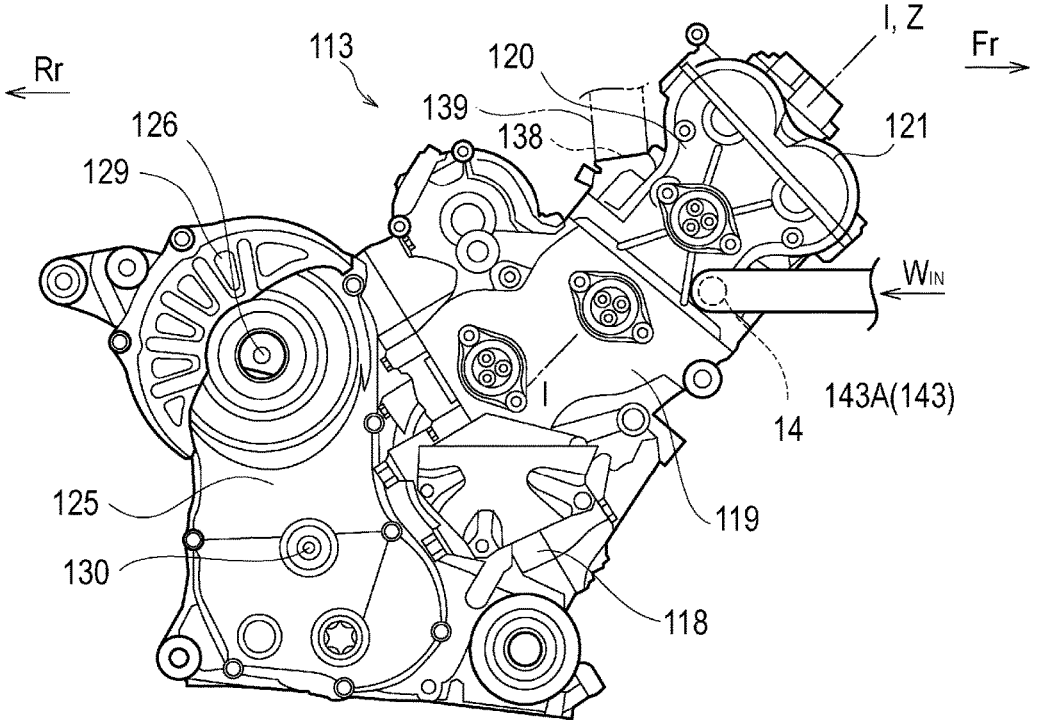
FIG. 2 is a right side view of an engine unit according to the embodiment of the present invention.
Figure 3:
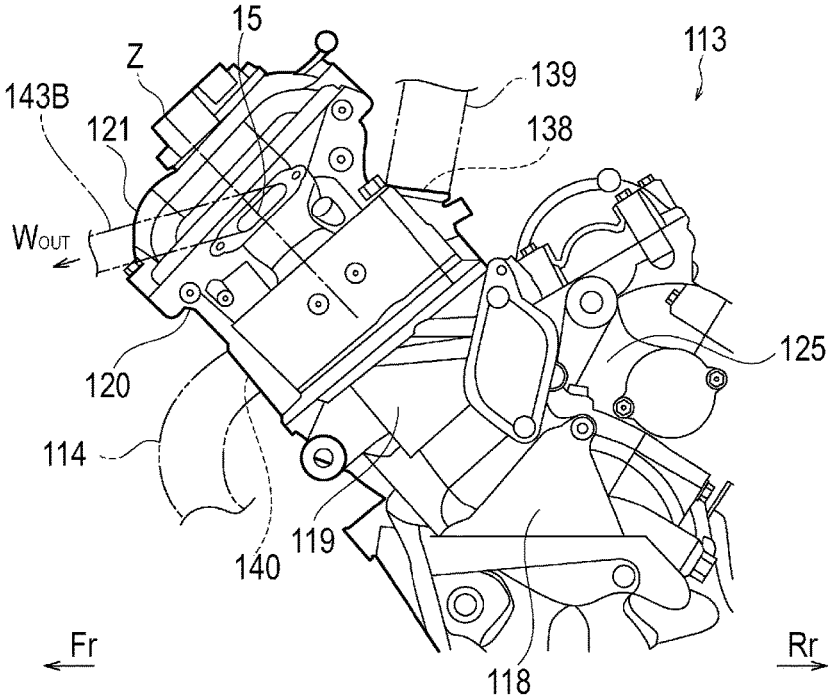
FIG. 3 is a left side view of the engine unit according to the embodiment of the present invention.
Figure 4:
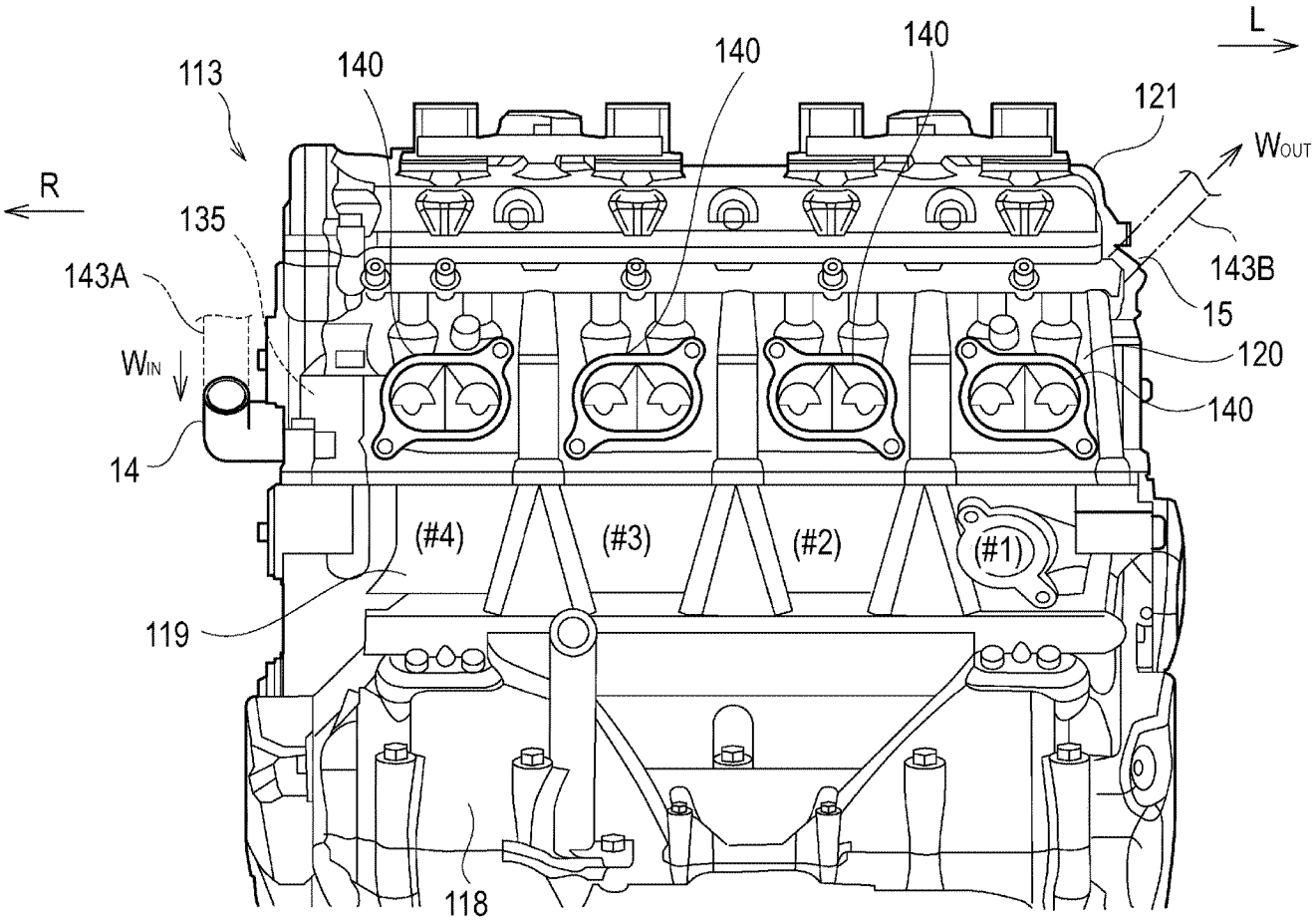
FIG. 4 is a front view of a front surface of the engine unit according to the embodiment of the present invention.

Next, the following describes the outline of the engine unit 113. FIG. 2 is a right side view of the engine unit 113. FIG. 3 is a left side view of the engine unit 113. FIG. 4 is a front view of the engine unit 113. The following appropriately gives a description giving reference numerals as necessary in the respective drawings. In this embodiment, the engine of the engine unit 113 may be, for example, a four-cycle, multicylinder, typically a parallel, four-cylinder engine. As illustrated in FIG. 4, in this example, cylinders No. 1 (denoted as #1) to #4 are disposed from the left in the right-left (the vehicle width) direction. As illustrated in FIG. 2 or a similar drawing, the engine unit 113 in this embodiment is formed by integrally joining a cylinder block 119, a cylinder head 120, and a cylinder head cover 121 in this order together on the upper portion of a crankcase 118. As illustrated in FIG. 2, a cylinder axis line Z is inclined forward by a predetermined angle. The engine unit 113 is suspended to the vehicle body frames 101 via a plurality of engine mounts to be integrally joined to and supported by the vehicle body frames 101, acting as a rigid member of the vehicle body frames 101 by itself.

Figure 5:
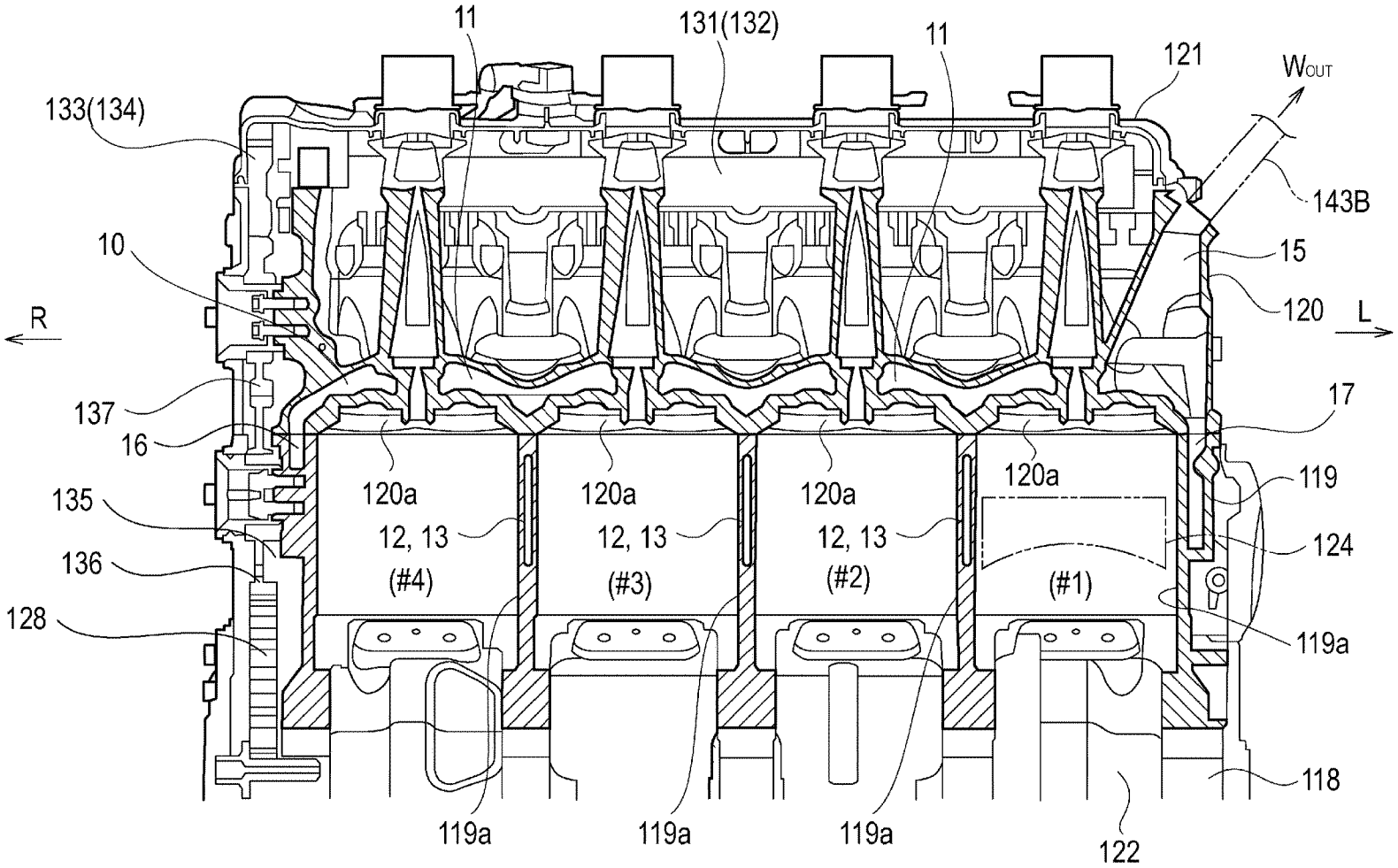
FIG. 5 is a cross-sectional view taken along the line I-I in FIG. 2, which approximately corresponds to a cylinder axis line in the engine unit according to the embodiment of the present invention.
Figure 6:
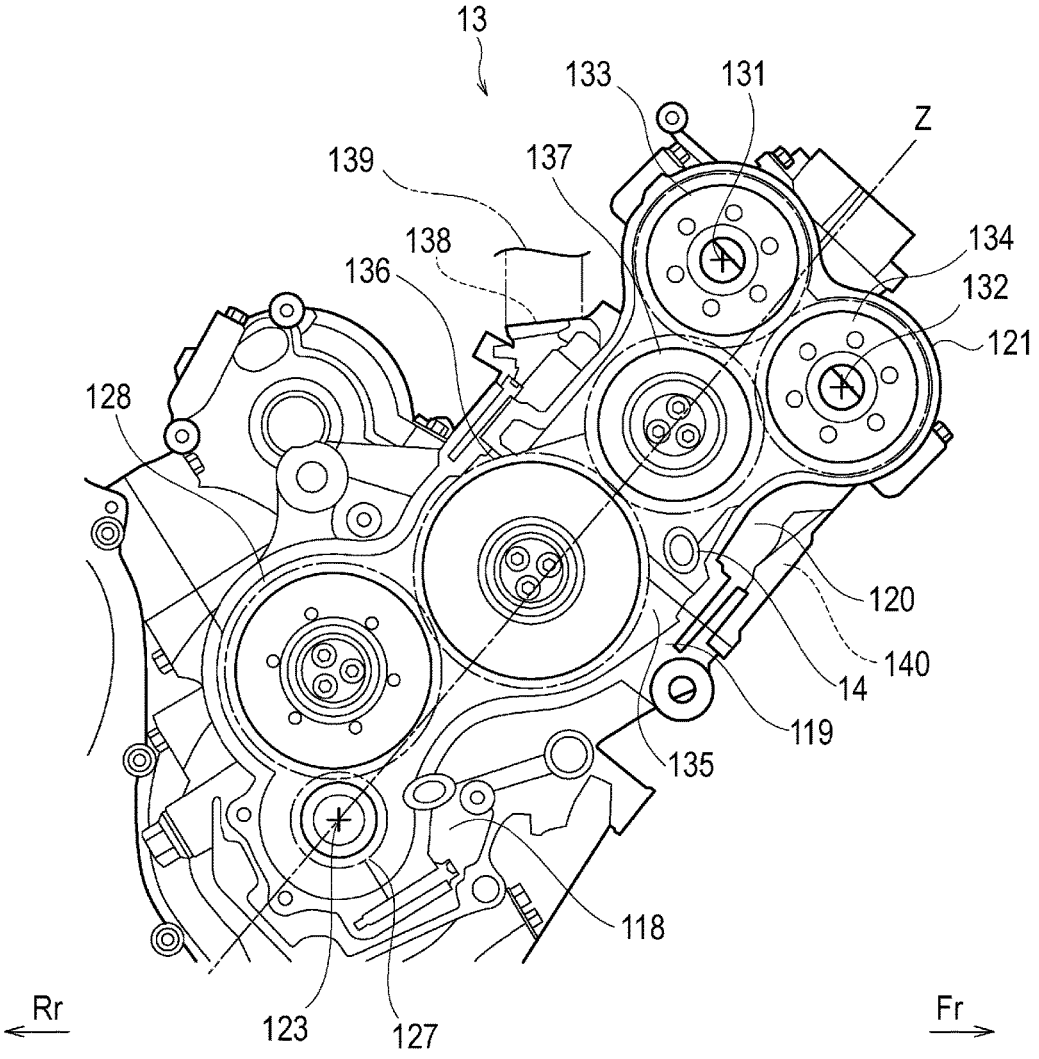
FIG. 6 is a drawing illustrating a configuration example of a cam gear chamber disposed on a right surface portion of the engine unit according to the embodiment of the present invention.

Also with reference to FIG. 5 and FIG. 6, a crankshaft 123 and a crank web are rotatably and pivotally supported to each cylinder in a crank chamber 122 in the crankcase 118. The crank web rotates integrally with the crankshaft 123. FIG. 5 is a cross-sectional view taken along the line I-I in FIG. 2, which approximately corresponds to the cylinder axis line Z. Between the mutual crank webs, a connecting rod is coupled via a crank pin. A piston 124 (abbreviated by the two-dot chain line in FIG. 5) is swingably mounted to a distal end (a small end portion) of the connecting rod via a piston pin. The piston 124 reciprocates along the cylinder axis line direction in a cylinder bore 119*a* in the cylinder block 119. This rotatively drives the crankshaft 123.

As illustrated in FIG. 2 or a similar drawing, a transmission case 125 is formed integrally with the rear portion of the crankcase 118. This transmission case 125 internally includes a counter shaft 126 at rear of the crankshaft 123 and parallel to the crankshaft 123. A primary drive gear (not illustrated) is mounted to one end of the crankshaft 123. In this case, an idle gear (not illustrated), which meshes with the primary drive gear, is interposed. Via the idle gear, the crankshaft 123 and the counter shaft 126 are coupled. The counter shaft 126 constitutes a part of a transmission housed in the transmission case 125. A clutch device 129 is configured on an end portion of the counter shaft 126 projecting to the clutch chamber side coaxially with the counter shaft 126.

A drive shaft 130 (FIG. 2) is disposed approximately below the counter shaft 126 inside the transmission case 125. A plurality of transmission gears are disposed in a row on the respective counter shaft 126 and drive shaft 130. A gear shift device selectively configures a meshing relationship of these transmission gears. Thus, a desired transmission ratio of the transmission is obtained. The power from the engine goes through from the crankshaft 123 to the transmission and is finally transmitted to a drive sprocket, which is mounted to a shaft end of the drive shaft 130. This drive sprocket rotatively drives a driven sprocket, that is, the rear wheel 110 via a power transmission chain.

In a valve system of the engine, as illustrated in FIG. 6, the cylinder head 120 includes camshafts 131 and 132 (see also FIG. 5). The camshafts 131 and 132 drive and control respective intake cam and exhaust cam. In this example, between cam gears 133 and 134, which are mounted to the right shaft end portions of the camshafts 131 and 132, and a cam drive gear 127 is coupled via a gear train formed of a plurality of gears. That is, with reference to FIG. 5 and FIG. 6, the cam gear chamber 135 (the storage chamber) is disposed at the right surface portion of the engine (cylinder #4) from the crankcase 118, the cylinder block 119, the cylinder head 120, and to the cylinder head cover 121. In this cam gear chamber 135, sequentially from a cam gear 128, a cam gear 136 and a cam gear 137, and further the cam gears 133 and 134 mesh with each other. In this manner, via the gear train, the crankshaft 123 and the camshafts 131 and 132 are coupled. In accordance with this, a valve gear is driven synchronized with the rotation of the crankshaft 123. The intake cam and the exhaust cam drivingly open and close the respective intake valve and exhaust valve at a predetermined timing.

In the above-described case, especially the cam gear 136 or a similar member has the center axis biased to the intake side as illustrated in FIG. 6. In this manner, biasing the gear train to the intake side ensures securing an exhaust side space in the cam gear chamber 135.

In this example, an angle formed by an intake side valve stem (not illustrated) with respect to the cylinder axis line Z is configured smaller than an exhaust side valve stem (not illustrated). Therefore, the camshaft 131 is positioned upward with respect to the camshaft 132.

The engine unit 113 additionally includes an intake system, an exhaust system, a cooling system, a lubricating system, and a control system (ECU: Engine Control Unit). The intake system supplies air-fuel mixture, which is formed of air (intake air) and fuel suppled from the respective air cleaner and fuel supply device. The exhaust system exhausts exhaust gas generated after burning inside the cylinders from the engine. The cooling system cools the engine. The lubricating system lubricates a movable portion of the engine. The control system operates and controls the systems. By the control by the control system, a plurality of function systems cooperates with the above-described auxiliary machines or a similar machine. Thus, a smooth operation is performed as the entire engine unit 113.

More specifically, as the configuration example of the intake system, intake ports 138 (the approximate position of the intake ports 138 is illustrated by the dotted line in FIG. 2) are open at the rear portion of the cylinder heads 120 in all the cylinders #1 to #4. A throttle body 139 (or an intake pipe coupled to the throttle body 139) is coupled to an intake port 138. Meanwhile, the air cleaner (not illustrated) is housed and disposed in an inner space or a space formed between the right and left vehicle body frames 101. The air cleaner and the engine unit 113, especially the cylinder head 120, are coupled with the throttle body 139, which constitutes the intake device. A throttle valve (not illustrated) is mounted to the throttle body 139. The throttle valve opens and closes an intake flow passage or a passage formed inside the throttle body 139 according to the accelerator position. This throttle valve controls a flow rate of air supplied from the air cleaner. An injector for fuel injection is mounted to each throttle body 139 at a downstream of the throttle valve. Fuel inside the fuel tank 116 is supplied from the fuel pump to each injector.

In this example, an intake passage that couples an engine combustion chamber, which communicates with the intake port 138, and the air cleaner may have an air intake structure of a so-called downdraft type. In the structure, the throttle body 139 is longitudinally disposed in an approximately perpendicular direction. The air purified by the air cleaner is suctioned by the intake device. The above-described control by the control system opens and closes the throttle valve at a predetermined timing and causes each injector to inject fuel to the inside of the intake passage. Accordingly, the air-fuel mixture at a predetermined air-fuel ratio is supplied to the intake ports 138 of the cylinder head 120. A valve drive mechanism, which mechanically, electrically, or electromagnetically drives a throttle valve shaft by the control by the control system, drives the throttle valve.

With the configuration example of the exhaust system, as illustrated in FIG. 4, exhaust ports 140 open at the front portions of cylinder heads 120 in all the cylinders #1 to #4. To these exhaust ports 140, the exhaust pipes 114 (see FIG. 1, FIG. 3, or a similar drawing) are coupled. As illustrated in FIG. 1, the exhaust pipe 114 in each cylinder once extends downward from the exhaust port 140, meanders into the lower side of the crankcase 118, and then is coupled to a collecting pipe 141 like this example. This collecting pipe 141 may incorporate a catalyst. The exhaust pipe 114 further extends to the rear from the collecting pipe 141 and then is coupled to the muffler 115.

Further, lubricating oil is supplied to the movable portions of the engine unit 113, thus configuring a lubricating system, which lubricates the movable portions. This lubricating system includes a valve gear, which is configured inside the crankshaft 123 and the cylinder head 120, the gear train, which couples these members, the transmission, or a similar component. This embodiment uses a usual oil pump for the lubricating system. This oil pump supplies the lubricating oil, which is taken up from an oil pan disposed at the lower portion of the engine, to the lubricating system.

In the cooling system, a water jacket, which will be described later, is configured at the peripheral area of the cylinder including the cylinder block 119 and the cylinder head 120. The water jacket is formed to circulate cooling water. As illustrated in abbreviation in FIG. 1, a radiator 142 (a heat exchanger) is equipped. The radiator 142 cools the cooling water supplied to the engine including the water jacket. The radiator 142 blows travelling air to dissipate heat of cooling water flowing through the inside. The radiator 142 has, for example, a rectangular shape in front view and is supported by the vehicle body frames 101 so as to be disposed corresponding to the approximately front of the cylinder head 120. A water pump (not illustrated) to circulate cooling water to the cooling system is provided. The cylinder, the radiator 142, and the water pump are mutually coupled with a cooling water hose, and the details will be described later.

Next, the cooling water passage structure of the internal combustion engine of the present invention includes a cylinder-block-side cooling water passage and a cylinder-head-side cooling water passage. The cylinder-block-side cooling water passage is formed inside the cylinder block 119 to cause cooling water to flow through. The cylinder-head-side cooling water passage is formed inside the cylinder head 120 to cause cooling water to flow through.

Figure 7:
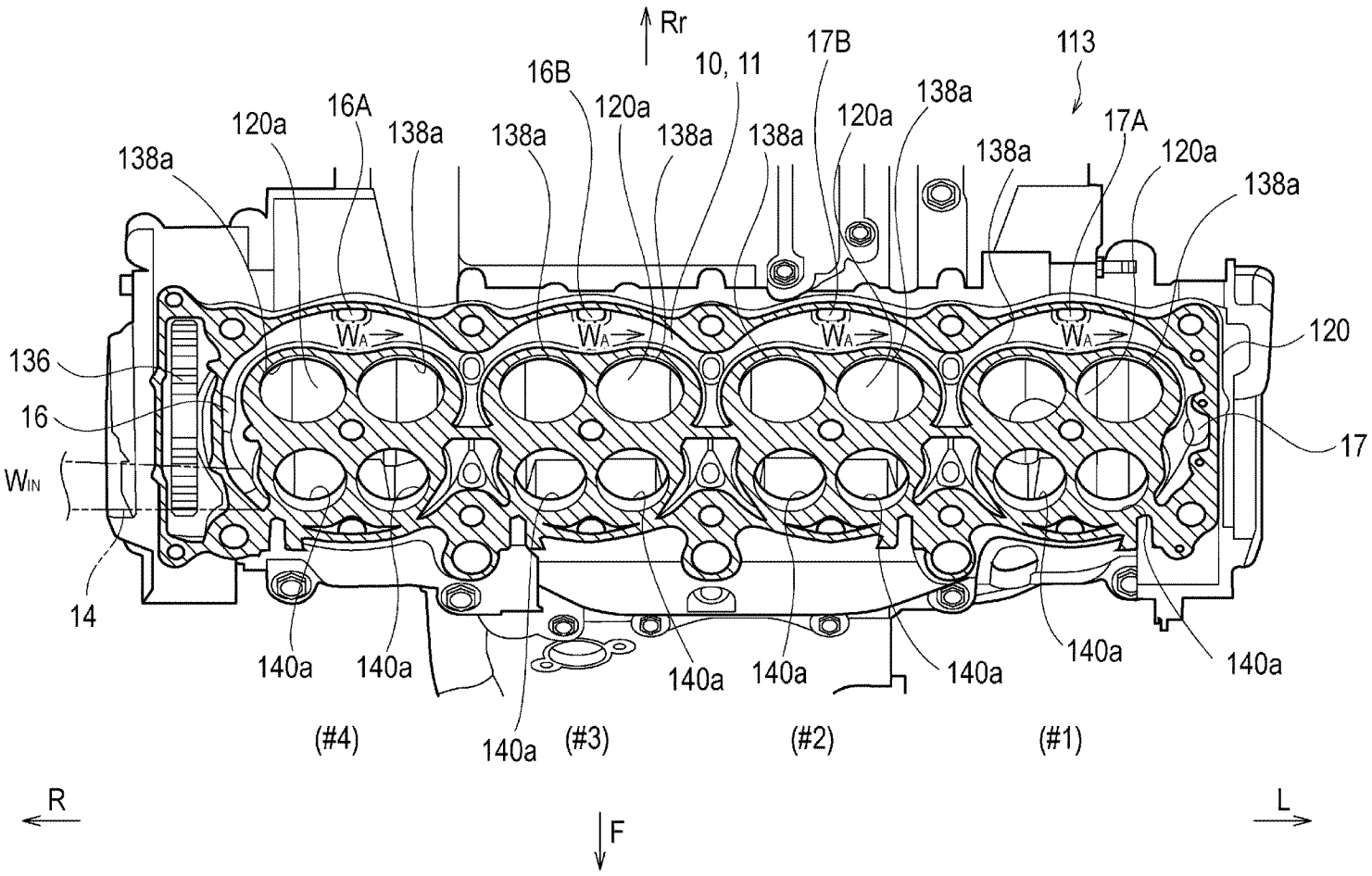
FIG. 7 is a cross-sectional view of cylinder heads of the engine unit according to the embodiment of the present invention viewed from the below taken along an approximately perpendicular direction to the cylinder axis line.

First, as illustrated in FIG. 5, a cylinder-head-side cooling water passage 10 is formed so as to surround the peripheral areas of respective combustion chambers 120*a* in the cylinders #1 to #4 in the cylinder heads 120. The cylinder-head-side cooling water passage 10 is configured of a water jacket 11, which communicates with one another between the adjacent cylinders. FIG. 5 is a cross-sectional view taken approximately along the cylinder axis lines of the respective cylinders #1 to #4. Here, in this example, the respective intake port 138 and exhaust port 140 in each cylinder branch, and thus includes two intake ports 138*a* and two exhaust ports 140*a* communicating with a combustion chamber 120*a* as illustrated in FIG. 7. Each cylinder has a so-called four-valve valve structure formed by mounting intake valves and exhaust valves to these intake ports 138*a* and exhaust ports 140*a*. FIG. 7 is a cross-sectional view taken along the approximately perpendicular direction to the cylinder axis lines so as to pass through the intake ports 138*a* and the exhaust ports 140*a* in the respective cylinders. FIG. 7 is a drawing viewing the cylinder block 119 side direction from the cylinder head 120 side. As illustrated in FIG. 7, the water jacket 11 is formed so as to surround the peripheral area of these intake ports 138*a* and the exhaust ports 140*a*.

Figure 8:
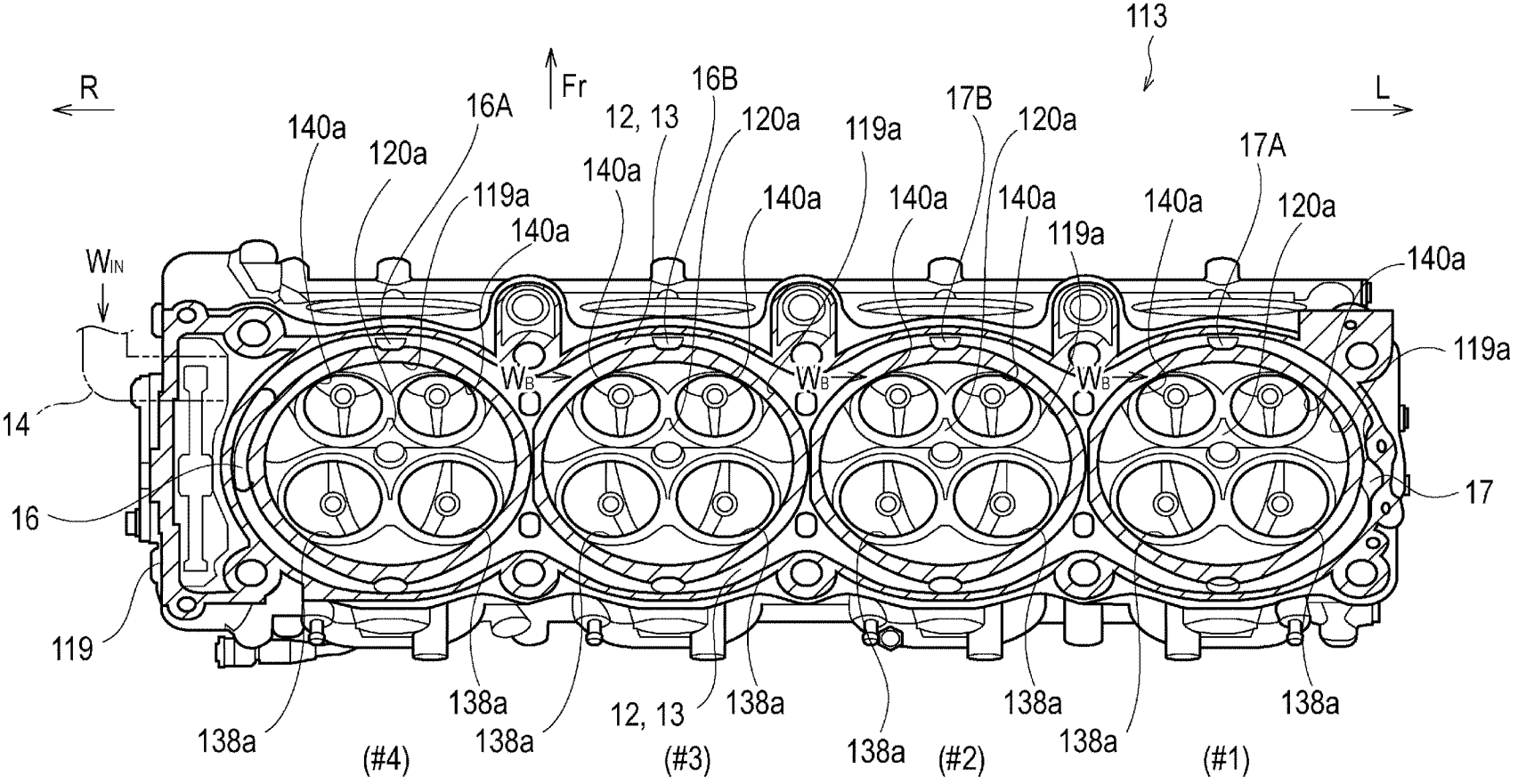
FIG. 8 is a cross-sectional view of a cylinder block of the engine unit according to the embodiment of the present invention viewed from the above taken along the approximately perpendicular direction to the cylinder axis line.

As illustrated in FIG. 8, in the cylinder block 119, a cylinder-block-side cooling water passage 12 is formed surrounding the peripheral areas of respective cylinder bores 119*a* in the cylinders #1 to #4. The cylinder-block-side cooling water passage 12 is configured of a water jacket 13, which communicates with one another between the adjacent cylinders. FIG. 8 is a cross-sectional view taken along the approximately perpendicular direction to the cylinder axis lines so as to pass through the cylinder bores 119*a* in the respective cylinders. FIG. 8 is a drawing viewing the cylinder block 119 side direction from the cylinder head 120 side.

The engine, which includes the above-described cylinder-head-side cooling water passage 10 and cylinder-block-side cooling water passage 12, and the radiator 142, which is the heat exchanger for dissipating the heat of cooling water to external air to decrease the temperature of the cooling water, are mutually coupled with a cooling water hose 143, which is a cooling water passage pipe (for these components, see FIG. 1. FIG. 1 illustrates a cooling water hose 143A for cooling water on the engine inlet side). Via the cooling water hose 143, the engine exchanges the cooling water with the radiator 142.

As illustrated in FIG. 2, with the cooling water passage structure of internal combustion engine of the present invention, the cylinder head 120 especially includes a cooling water inlet 14. The cooling water hose 143A is coupled to the cooling water inlet 14 and the cooling water from the radiator 142 flows into the cooling water inlet 14. The one end side of the cooling water hose 143A is coupled to the radiator 142. The other end side extends to the engine side and is coupled to the cooling water inlet 14, which is disposed on the right surface portion of the cylinder head 120. The cooling water cooled by the radiator 142 flows into this cooling water inlet 14 from the radiator 142 via the cooling water hose 143A (the arrow $W_{IN}$ in FIG. 2).

Figure 9:
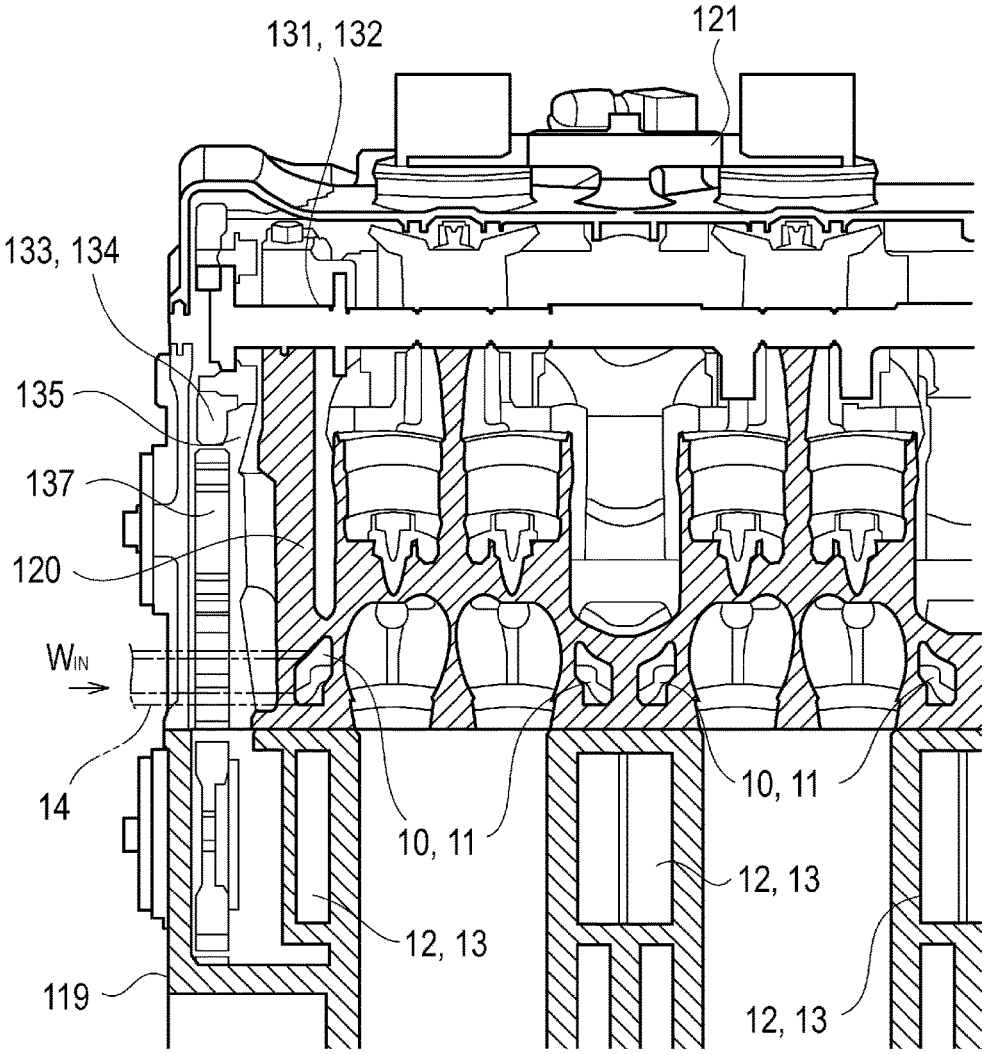
FIG. 9 is a cross-sectional view illustrating a circumference of a cooling water inlet in the engine unit according to the embodiment of the present invention.

Specifically, the cooling water inlet 14 can be formed into a tubular shape with a pipe member or a similar member. As illustrated in FIG. 2 and FIG. 4, the cooling water inlet 14 is mounted to the right side surface of a cam gear chamber 135, which is disposed right side of the cylinder head 120 of the cylinder #4. As illustrated in FIG. 6, the cooling water inlet 14 is disposed passing through the inside of the cam gear chamber 135. Additionally, as illustrated in FIG. 7 or FIG. 9, the cooling water inlet 14 passes through the right sidewall portion of the cylinder head 120 of the cylinder #4 and communicates with the water jacket 11 of the cylinder #4.

In this case, as illustrated in FIG. 2, FIG. 6, or a similar drawing, the cooling water inlet 14 is disposed biased to the exhaust port 140 side with respect to the cylinder axis line Z on the side surface of the cylinder head 120 (see also FIG. 8).

With the cooling water passage structure of the present invention, as illustrated in FIG. 3 or FIG. 4, a cooling water hose 143B is coupled to the cylinder head 120. The cylinder head 120 includes a cooling water outlet 15 through which the cooling water flows out from the engine to the radiator 142. The one end side of the cooling water hose 143B, which is illustrated in FIG. 3, is coupled to the radiator 142. The other end side extends to the engine side and is coupled to the cooling water outlet 15, which is disposed on the left surface portion (the cylinder #1) of the cylinder head 120. The cooling water that has flown through the inside of the engine flows out from the cooling water outlet 15 to the radiator 142 via the cooling water hose 143B (the arrow $W_{OUT}$ in FIG. 3 or FIG. 4).

Specifically, as illustrated in FIG. 5, the cooling water outlet 15 is formed communicating with the water jacket 11 of the cylinder #1 on the left sidewall portion of the cylinder head 120 of the cylinder #1.

In this case, with reference to FIG. 4 or a similar drawing, the cooling water outlet 15 is disposed upward with respect to the cooling water inlet 14 of the cylinder head 120.

The cooling water outlet 15 of the cylinder head 120 is disposed at the cylinder #1, which is the opposite side from the cooling water inlet 14 at the cylinder #4, among the side surfaces of the cylinder head. As illustrated in FIG. 3, the cooling water outlet 15 is disposed biased to the intake port 138 side with respect to the cylinder axis line Z.

In the cylinder head 120, the cooling water flows from the radiator 142 to the cooling water inlet 14 via the cooling water hose 143A. From the cooling water inlet 14, first, the cooling water flows into the cylinder-head-side cooling water passage 10 in the cylinder #4. In this case, as illustrated in the arrow $W_A$ in FIG. 7, some cooling water flowing in flows through to the cylinders #4 to #1 in the water jacket 11. The cooling water flowing through the inside of the cylinder-head-side cooling water passage 10 flows out to the radiator 142 via the cooling water hose 143B (FIG. 5) from the cooling water outlet 15 at the cylinder #1.

Additionally, with the cooling water passage structure of internal combustion engine of the present invention, the cylinder-head-side cooling water passage 10 branches at the upstream at the intermediate portion in a cylinder-rowing direction. The one branched cylinder-head-side cooling water passage 10 communicates with the cylinder-block-side cooling water passage 12 to cause the cooling water to flow to the cylinder block 119 side.

Typically, as illustrated in FIG. 5, a communication hole 16 for both the cylinder block 119 and the cylinder head 120 is disposed at the right side portion of a joining portion of the cylinder block 119 and the cylinder head 120 at the cylinder #4, namely, as illustrated in FIG. 7 or FIG. 8, at a portion near the cooling water inlet 14. That is, the cooling water flowing in from the cooling water inlet 14 branches at the communication hole 16, and some of the cooling water flows into the cylinder-block-side cooling water passage 12. As illustrated in the arrow $W_B$ in FIG. 8, some cooling water flowing in flows through to the cylinders #4 to #1 in the water jacket 13.

The cylinder-head-side cooling water passage 10 communicates with the cylinder-block-side cooling water passage 12 at the downstream at the intermediate portion in the cylinder-rowing direction to converge the cooling water that has flown through the cylinder block 119 side to the cylinder head 120 side.

Typically, as illustrated in FIG. 5, a communication hole 17 for both the cylinder block 119 and the cylinder head 120 is disposed at the left side portion of a joining portion of the cylinder block 119 and the cylinder head 120 at the cylinder #1, namely, at a portion near the cooling water outlet 15. As also illustrated in FIG. 7 or FIG. 8, disposing the communication hole 17 causes the cooling water that has flown through the cylinder-block-side cooling water passage 12 to flow in the cylinder-head-side cooling water passage 10 side.

In the above-described case, as illustrated in FIG. 7 or FIG. 8, communication holes 16A and 16B can be disposed on second and third upstream sides. These communication holes 16A and 16B communicate with the cylinder-block-side cooling water passage 12 at downstream of the communication hole 16 to cause the cooling water to flow to the cylinder block 119 side.

Similarly, communication holes 17A and 17B can be disposed on the second and third downstream sides. These communication holes 17A and 17B communicate with the cylinder-block-side cooling water passage 12 at upstream of the communication hole 17 to converge the cooling water that has flown through the cylinder block 119 side to the cylinder head 120 side.

The cooling water passage structure of internal combustion engine according to the present invention is configured as described above, and the following describes main advantageous effects or similar effects.

As illustrated in FIG. 2, to the cylinder head 120, the cooling water hose 143A is coupled. The cylinder head 120 includes the cooling water inlet 14 into which cooling water from the radiator 142 flows.

The cooling water cooled by the radiator 142, which is the heat exchanger, is first supplied to the cylinder head 120. This ensures sufficiently cooling the cylinder head 120 regardless of a cooling situation of the cylinder block 119.

The cylinder-head-side cooling water passage 10 branches at the upstream at the intermediate portion. The one branched cylinder-head-side cooling water passage 10 communicates with the cylinder-block-side cooling water passage 12 to cause the cooling water to flow to the cylinder block 119 side.

The cooling water cooled by the radiator 142 is supplied to the cylinder block 119 via the cylinder head 120. This causes the cooling water once warmed at the cylinder head 120 to flow through inside the cylinder block 119. Accordingly, the cylinder block 119 is less likely to be overcooled. Additionally, this promotes evaporation of fuel attached to the inner walls of the cylinder bores 119*a* in the respective cylinders, ensuring enhancing combustion efficiency.

The cylinder head 120 includes the cooling water outlet 15 through which the cooling water flows out.

The outlet for cooling water warmed inside the cylinder head 120 is disposed at the cylinder head 120, which is positioned on the upper portion of the engine. This causes air bubbles in the cooling water generated in the cylinder-head-side cooling water passage 10 to flow to the cooling water outlet 15 and to be easily discharged to the outside.

The cylinder-head-side cooling water passage 10 communicates with the cylinder-block-side cooling water passage 12 at the downstream at the intermediate portion to converge the cooling water that has flown through the cylinder block 119 side to the cylinder head 120 side.

The cooling water warmed inside the cylinder block 119 is guided to the cylinder head 120 side positioned upward such that the cooling water is discharged together with the cooling water that has flown through the cylinder block 119. By thus forming the cooling water passage, the air bubbles in the cooling water generated inside the cylinder-block-side cooling water passage 12 are also easily discharged to the outside.

The cooling water inlet 14 at the cylinder head 120 is disposed on the side surface of the cylinder head 120 biased to the exhaust port 140 side with respect to the cylinder axis line Z.

Since the number of auxiliary machines (such as the throttle body 139 and the air cleaner) disposed close to a tightening bolt on the exhaust side of the cylinder head 120 is less than those on the intake side, the tightening bolt on the exhaust side is less likely to be restricted on arrangement. Therefore, a space at which a cooling water passage is provided is easily secured widely on the discharge side of the cylinder head 120. Providing the cooling water inlet 14 on the exhaust side eases the cooling water to flow through, leading to improvement of a cooling effect.

The cooling water outlet 15 at the cylinder head 120 is disposed above the cooling water inlet 14 at the cylinder head 120.

Positioning the cooling water outlet 15 higher than the cooling water inlet 14 makes it easier for the air bubbles in the cooling water to be discharged to the outside.

The cooling water outlet 15 at the cylinder head 120 is disposed on the opposite side from the cooling water inlet 14 among the side surfaces of the cylinder head 120. The cooling water outlet 15 is disposed biased to the intake port 138 side with respect to the cylinder axis line Z.

In the cylinder head 120 with the camshaft 131 on the intake side disposed upward with respect to the camshaft 132 on the exhaust side, disposing the cooling water outlet 15 on the intake side positions the cooling water outlet 15 higher than the cooling water inlet 14. This makes the air bubbles in the cooling water to be easily discharged to the outside.

The cylinder head 120 includes the cam gear chamber 135, which is a storage chamber housing drive mechanisms of the valve gear, on the end portion at the one side of the cylinder head 120. The cooling water inlet 14 passes through this cam gear chamber 135 to communicate the cylinder-head-side cooling water passage 10 and the outside of the cylinder head 120.

The cooling water inlet 14 is disposed so as to pass through a gear group constituting the drive mechanisms of the valve gear, especially a space on the exhaust side between the cam gear 136 and the cam gear 137. This eases widely securing the space for providing the cooling water passage on the discharge side of the cylinder head 120, which is less likely to be restricted on arrangement. This eases for the cooling water to flow through, leading to improvement of the cooling effect.

While the present invention has been described using various embodiments above, the present invention is not limited only to these embodiments. Changes and similar modification are possible within the scope of the present invention.

With the embodiment, the positional relationship between the cooling water inlet 14 and the cooling water outlet 15 may be a left-right reversal. That is, the cooling water inlet 14 is configured on the left side surface of the cylinder head 120, and the cooling water outlet 15 is configured on the right side surface of the cylinder head 120.

The engine unit 113 is similarly applicable to a multicylinder engine other than four cylinders, namely, for example, parallel, six cylinders.

According to the present invention, the cooling water cooled by the heat exchanger is first supplied to the cylinder head. This ensures sufficiently cooling the cylinder head regardless of a cooling situation of the cylinder block. The one branched cylinder-head-side cooling water passage communicates with the cylinder-block-side cooling water passage to cause the cooling water to flow to the cylinder block side. In this manner, by supplying the cooling water to the cylinder block via the cylinder head, the cooling water once warmed at the cylinder head flows through the inside of the cylinder block. Accordingly, the cylinder block is less likely to be overcooled, ensuring enhancing a combustion efficiency in each cylinder.

What is claimed is:

1. A cooling water passage structure of internal combustion engine provided with a cylinder block, a cylinder head, and a cylinder head cover sequentially combined on a crankcase of the engine, the cooling water passage structure comprising:

a cylinder-block-side cooling water passage formed inside the cylinder block of the engine to cause cooling water to flow through;

a cylinder-head-side cooling water passage formed inside the cylinder head to cause cooling water to flow through;

a heat exchanger configured to dissipate heat of cooling water to external air to decrease a temperature of the cooling water; and a cooling water passage pipe that couples the heat exchanger and the engine to exchange cooling water, wherein the cylinder head comprises:

a cooling water inlet connected to the cooling water passage pipe to receive the cooling water flowing from the heat exchanger;

a cooling water outlet from which the cooling water is output; and a storage chamber on an end portion at one side of the cylinder head, the storage chamber housing a drive mechanism of a valve gear, the cooling water inlet passing through the storage chamber to communicate the cylinder-head-side cooling water passage and an outside of the cylinder head, wherein the storage chamber stores a gear group included in a drive mechanism of a valve gear, and the cooling water inlet is provided in the exhaust port side with respect to the gear group, wherein the cooling water inlet of the cylinder head is provided on a side surface of the cylinder head, wherein the cooling water outlet of the cylinder head is provided opposite to the cooling water inlet on the side surface of the cylinder head, and wherein the cooling water outlet of the cylinder head is disposed over the cooling water inlet of the cylinder head as seen in a front view of the engine.

2. The cooling water passage structure of internal combustion engine according to claim 1, wherein the cylinder-head-side cooling water passage branches at an upstream at an intermediate portion, the one branched cylinder-head-side cooling water passage communicating with the cylinder-block-side cooling water passage to cause cooling water to flow to the cylinder block side.

3. The cooling water passage structure of internal combustion engine according to claim 1, wherein the cylinder-head-side cooling water passage communicates with the cylinder-block-side cooling water passage at a downstream at an intermediate portion to converge cooling water that has flown through the cylinder block side to cooling water on the cylinder head side.

4. The cooling water passage structure of internal combustion engine according to claim 1, wherein the cooling water inlet of the cylinder head is disposed biased to an exhaust port side with respect to a cylinder axis line as seen in a side view of the cylinder head.

5. The cooling water passage structure of internal combustion engine according to claim 1, wherein the cooling water outlet being disposed biased to an intake port side with respect to a cylinder axis line as seen in a side view of the cylinder head.

6. The cooling water passage structure of internal combustion engine according to claim 1, wherein the cooling water outlet of the cylinder head is provided in an uppermost portion of the cylinder-head-side cooling water passage as seen in a front view of the engine.

7. The cooling water passage structure of internal combustion engine according to claim 1, wherein the cooling water outlet of the cylinder head is opened to an obliquely upper outer side.

8. The cooling water passage structure of internal combustion engine according to claim 2, further comprising:

a first communication hole that allows the cylinder-head-side cooling water passage and the cylinder-block-side cooling water passage to communicate with each other is provided in the vicinity of the cooling water inlet, and wherein the first communication hole is provided in an outer side portion of a cylinder-rowing direction of a joining portion between the cylinder block and the cylinder head of a cylinder nearest to the cooling water inlet of the cylinder head.

9. The cooling water passage structure of internal combustion engine according to claim 3, further comprising:

a second communication hole that allows the cylinder-head-side cooling water passage and the cylinder-block-side cooling water passage to communicate with each other is provided in the vicinity of the cooling water outlet, and wherein the second communication hole is provided in an outer side portion of a cylinder-rowing direction of a joining portion between the cylinder block and the cylinder head of a cylinder nearest to the cooling water outlet of the cylinder head.

* * * * *